US005678278A

United States Patent [19]

McBride et al.

[11] Patent Number: 5,678,278

[45] Date of Patent: *Oct. 21, 1997

[54] CLEANROOM WASHING SYSTEM

[76] Inventors: John McBride, 713 Otis Blvd., Spartanburg, S.C. 29304; Michael D. Gluhanich, 4937 Dorchester Dr., Muskegan, Mich. 49441

[ * ] Notice: The term of this patent shall not extend beyond the expiration date of Pat. No. 5,507,065.

[21] Appl. No.: 533,750

[22] Filed: Sep. 26, 1995

Related U.S. Application Data

[63] Continuation of Ser. No. 164,955, Dec. 10, 1993, Pat. No. 5,507,065.

[51] Int. Cl.[6] ..... A47L 13/16; A47L 13/20

[52] U.S. Cl. ..... 15/228; 15/147.2; 15/244.1; 15/244.2; 15/244.3; 15/244.4

[58] Field of Search ..... 15/147.2, 228, 15/244.1–244.4

[56] References Cited

U.S. PATENT DOCUMENTS

| | | | |
|---|---|---|---|
| 2,064,502 | 12/1936 | Teare . | |
| 2,067,687 | 1/1937 | Teare . | |
| 2,092,569 | 9/1937 | Brell . | |
| 2,138,010 | 11/1938 | Metcalf . | |
| 2,164,398 | 7/1939 | Glover . | |
| 2,304,127 | 12/1942 | Stetson | 15/244.2 |
| 2,327,551 | 8/1943 | Petty . | |
| 2,429,626 | 10/1947 | Horn | 15/244.2 |
| 2,431,502 | 11/1947 | Podolak | 15/228 |
| 2,500,841 | 3/1950 | Fellman et al. | 15/228 |
| 2,548,331 | 4/1951 | Yamashiro | 15/244.2 |
| 2,655,680 | 10/1953 | Geerin | 15/228 |
| 2,891,270 | 6/1959 | Reiter | 15/244.1 |
| 2,942,285 | 6/1960 | Gray | 15/244.4 |
| 3,040,353 | 6/1962 | Gray | 15/244.3 |
| 3,099,855 | 8/1963 | Nash | 15/244.2 |
| 3,171,820 | 3/1965 | Volz | 15/244.1 |
| 3,406,420 | 10/1968 | Siemund | 15/223 |
| 3,453,677 | 7/1969 | Cutler | 15/228 |
| 3,720,976 | 3/1973 | Bailey . | |
| 3,750,220 | 8/1973 | Popeil et al. | 15/228 |
| 3,798,700 | 3/1974 | Popeil | 15/244.2 |
| 4,287,633 | 9/1981 | Gropper | 15/244.3 |
| 4,821,360 | 4/1989 | Giallouraris | 15/244.3 |
| 4,825,597 | 5/1989 | Matechuk | 51/392 |
| 4,852,201 | 8/1989 | Wundrock et al. | 15/145 |
| 4,888,229 | 12/1989 | Paley et al. | 15/209.1 |
| 4,971,471 | 11/1990 | Sloan | 15/228 |
| 5,212,847 | 5/1993 | Melcher et al. | 15/244.1 |
| 5,217,787 | 6/1993 | Monahan | 15/244.4 |
| 5,343,587 | 9/1994 | Findley | 15/228 |

*Primary Examiner*—Mark Spisich
*Attorney, Agent, or Firm*—Dority & Manning, P.A.

[57] ABSTRACT

A surface washing device that is specially designed for cleanroom environments is disclosed comprising an autoclavable frame member capable of attaching to a surface cleaning member, an autoclavable handle coupling member movably mounted on the frame member such that the frame is capable of being coupled to a handle, and an autoclavable surface cleaning member consisting of a liquid absorbent solvent resistant interior material and an abrasion resistant exterior material wherein the abrasion resistant solvent resistant material does not abrade creating loose fibers or lint and protects the liquid absorbent interior material from creating fibers and particles during use or wringing of the mop head.

18 Claims, 2 Drawing Sheets

FIG. 4
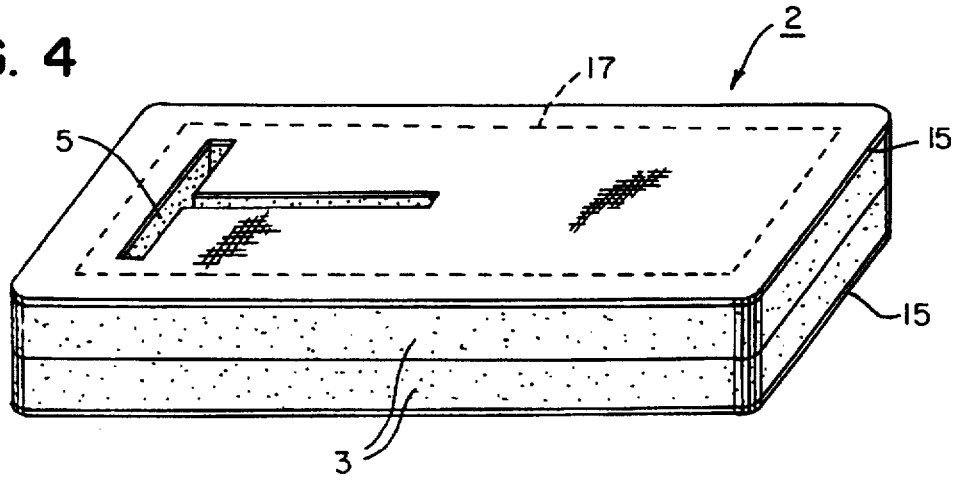
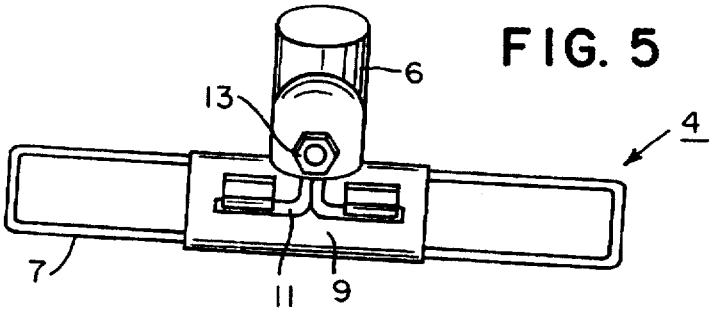
FIG. 5
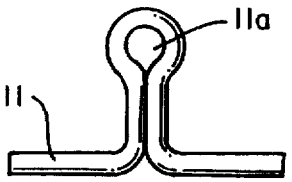
FIG. 5A
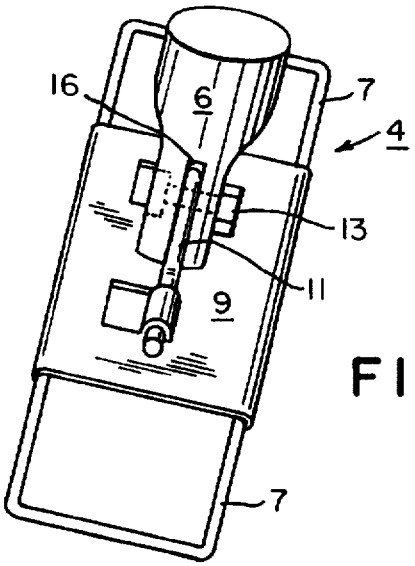
FIG. 6

CLEANROOM WASHING SYSTEM

This is a continuation of application Ser. No. 08/164,955, filed Dec. 10, 1993, U.S. Pat. No. 5,507,065.

FIELD OF INVENTION

The present invention relates to a hand held autoclavable device used for washing floor, ceiling and wall surfaces that does not contaminate the surface being cleaned with sponge or fabric particles. The present invention is particularly suitable for cleanroom environments.

BACKGROUND OF INVENTION

Industries having cleanrooms have long been struggling to find a way to properly clean the walls and other surfaces of cleanrooms. Cleanrooms are used in many industries and in many environments including surgical suites in hospitals and clinics, pharmaceutical and medical device manufacturing facilities, genetic engineering laboratories as well as the manufacture of micro-electronics. Problems associated with cleanroom environments concern cleaning up spills of a variety of fluids, both industrial and bodily, decontaminating the room with respect to micro-organisms, and removing lint and other particles from the cleanroom environment. The problems of cleaning these rooms have not been easily solved.

Typical solutions to the problems associated with cleaning cleanrooms have included using cloth wipes, tacky rollers, sponge and string mops. However, none of these systems presented a satisfactory cleaning system to meet all the needs of cleaning a cleanroom without creating additional problems, such as new forms of contamination either in the form of material particles or in the form of fabric dissolved in the cleaning or sanitizing solvents. For example, using cloth wipes is a very slow process done by hand. Because using cloth wipes is done by hand, it is often difficult to reach high areas. In order to reach the high or out of the way places, the person cleaning must be constantly moving a ladder. This makes the whole process labor intensive and time consuming.

The use of tacky rollers are inadequate because they are not as thorough as a wet applicator. Tacky rollers can only remove some particles and do not remove stains. Additionally, tacky rollers are not capable of distributing a disinfectant or sterilizing agent that is often a necessary cleaning step in hospital and clinic environments.

Sponge mops are not satisfactory because the usual foam sponge heads used have poor abrasion resistance during the wiping and wringing process. Consequently, while the sponge is being used, the sponge will often degrade and actually create undesirable fibers or particles that contaminate the environment. In addition most sponge mop systems have some sort of wringing attachment at the head of the mop. A wringing system on the end of the mop makes the entire system top heavy when an operator is working over head and leads to operator fatigue from lifting it up to clean ceilings or the walls in high places. An additional problem with using a sponge mop is that the mop head is not moveable in relation to the mop handle. The lack of mobility of the mop head with respect to the handle makes it difficult to clean in hard to reach areas such as corners and behind equipment or other wall obstructions.

Similarly, string mops are not satisfactory because the heads of these systems are not compatible with cleanroom environments. String mop heads are typically made from cotton and rayon which generate an extremely high amount of fibers and particles during use. This kind of contamination is unacceptable in cleanroom environments. Furthermore, various components in these systems are not autoclavable.

SUMMARY OF INVENTION

Therefore, it is the object of this invention to provide a room cleaning device that is suitable for use in cleanrooms. For purposes of this discussion, a cleanroom is defined as a room that requires a particle controlled working environment and may require that all surfaces be disinfected or sterilized against micro-organisms such as fungi, bacteria, molds and viruses. It is a further object of this invention to provide a room cleaning device that is suitable for distributing cleaning and disinfectant fluids without dissolving in those fluids, scrubbing stains on surfaces in the cleanroom and absorbing any liquids or semi-solid substances in the cleanrooms. Additionally, the present invention does not degrade or abrade during use or does so minimally and accordingly, creates very little additional lint or particles that could further contaminate the cleanroom environment. The present invention also provides for a means to clean ceilings, floors, walls and other surfaces that can be comfortably used by the operator. The cleaning surface of the present invention also has a flexible head so as to permit the operator to more readily reach corners and clean behind equipment or other obstructions.

It is a particular object of this invention to provide a cleaning system that is autoclavable so that the cleaning device itself can be repeatedly sterilized in heat and steam. The cleaning surface member of this invention further does not lose its, solvent resistance, abrasion resistance and liquid absorbency qualities and continues to have the ability to wick moisture through to the surface to be cleaned even after repeated autoclave treatments. If repeated use is not desired the cleaning surface member can be disposed of.

The present invention relates to the making of an autoclavable surface cleaning system, comprising an autoclavable frame member provided with free end portions substantially axially aligned. This frame member can be made of stainless steel, aluminum or high temperature plastic rod formed in a suitable shape so as to be capable of attaching to a cleanroom surface cleaning member. The frame member is shaped so as to further provide an internal skeletal support to the cleaning member. The frame member has an autoclavable handle coupling member movably mounted on said frame member such that the frame is capable of being connected to a handle. The coupling apparatus is moveable so that the cleanroom cleaning surface member can flex in at least one plane. Movement of the surface cleaning member allows for the ease of cleaning behind instruments and other equipment that are often in cleanrooms. The cleanroom surface cleaning member is made of autoclavable materials that provide an abrasion resistant exterior fabric on the surface and a liquid absorbing interior material below the surface. The cleanroom surface cleaning member is attached to the frame member in such a way so as to enclose or envelope the frame member. By enclosing the frame within the cleaning member, damage, caused by knocks and bumps during cleaning to delicate instruments that are in cleanroom, is avoided or lessened.

A clearer understanding of the invention may be had from the drawings.

BRIEF DESCRIPTION OF THE DRAWINGS

These and other more detailed objects of the present invention will be fully disclosed in the following detailed description of the drawings in which like numerals represent like elements and in which:

FIG. 4 is the side view of the fabric laminated to foam in accordance with one embodiment of the invention;

FIG. 5 is a plan view of the autoclavable mop head equipped with a coupling device in accordance with one embodiment of the invention;

FIG. 5*a* is a detail drawing of the hairpin bracket used in one embodiment of this invention to movable mount the coupling member to the mop head frame; and FIG. 6 is the side view of the autoclavable frame equipped with a coupling device in accordance with one embodiment of the invention.

DESCRIPTION OF THE PREFERRED EMBODIMENTS

Figure 1:
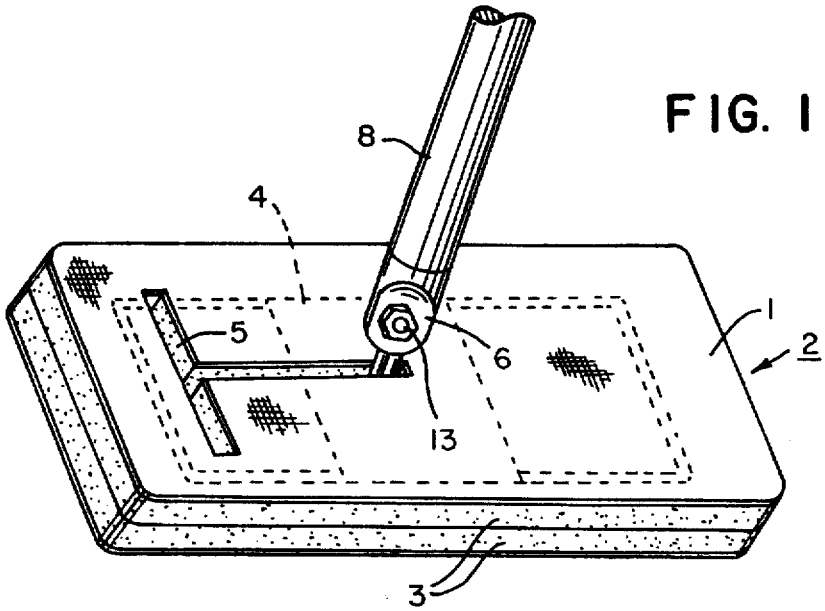
FIG. 1 is a perspective view of this invention mounted to a handle having the surface cleaning member mounted on the frame.

FIG. 1 illustrates one embodiment of the present invention as assembled for use by the person cleaning the cleanroom. This figure illustrates the cleaning surface member 2. Contained within the cleaning surface member 2 is the autoclavable frame 4. Frame 4 fits snugly into surface cleaning member 2 via the "T" shaped slit 5 on top surface 1 of surface cleaning member 2. Frame 4 is inserted into the "T" slit and fits into an existing pocket within the surface cleaning member 2. The perimeter of frame 4 is illustrated by the dashed lines appearing on top surface 1. Attached to top surface 1 is surface abrasion resistant exterior fabric 15 made from suitable fiber, typically synthetic, for scrubbing the walls, ceilings, floors and other surfaces within the cleanroom environment. This fabric is abrasion resistant in that it does not shed fibers or produce lint or particles when used as a scrubber. The fabric on top surface 1 is also sufficient porous to permit wicking from the liquid absorbent material 3, e.g. sponge or foam, through to the surface being cleaned. The liquid absorbent material 3 should be of sufficient density so as to permit frame 4 to snugly fit and be securely held within the internal region of the material.

Figure 2:
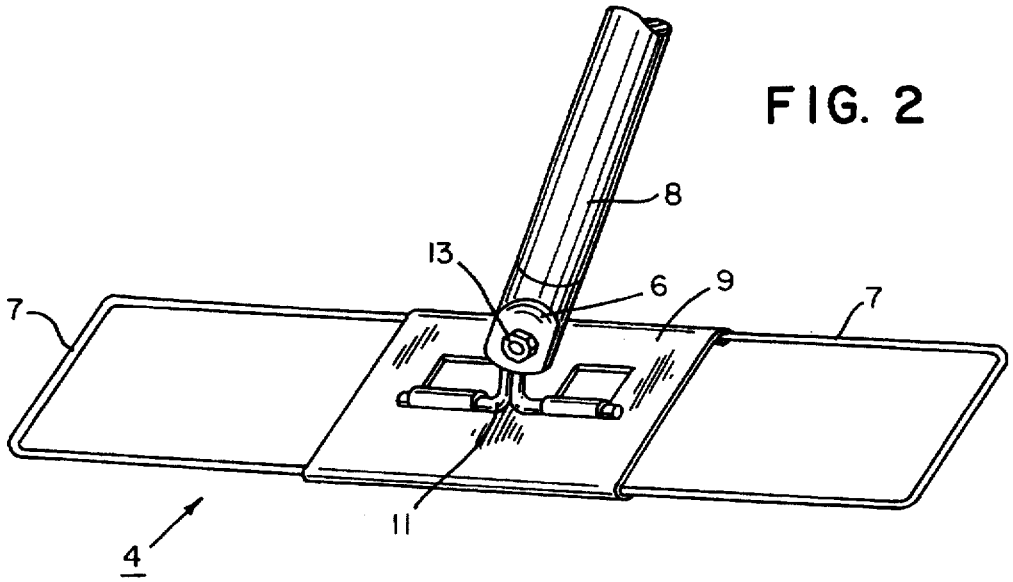
FIG. 2 is a perspective view of this invention mounted to a handle, without the surface cleaning member.

FIG. 2 illustrates frame 4. In the embodiment depicted frame 4 is made of a rod having a cylindrical cross-Section formed into a rectangular shape. Frame 4 can be constructed from any suitable material that can be subjected to heat and steam in an autoclave. The preferred material for frame 4 is stainless steel or aluminum. Frame 4 acts as a means to provide a skeletal support to the surface cleaning member 2 depicted in FIG. 1. Frame 4 also contains the coupling means to connect the surface cleaning member to handle 8. Attached to frame 4 is plate 9. Plate 9 bridges two sides of frame 4 and provides a platform onto which hairpin bracket apparatus 11 is secured. The hairpin bracket 11 fits into coupling device 6 and is secured by a bolt and nut 13. This method of securing bracket 11 to coupling device 6 permits coupling device 6 to move a full 180°° with respect to frame 4. That is, coupling device 6 can be positioned such that it is perpendicular to Frame 4 or the coupling device 6 can be moved such that it is parallel to frame 4.

Figure 3:
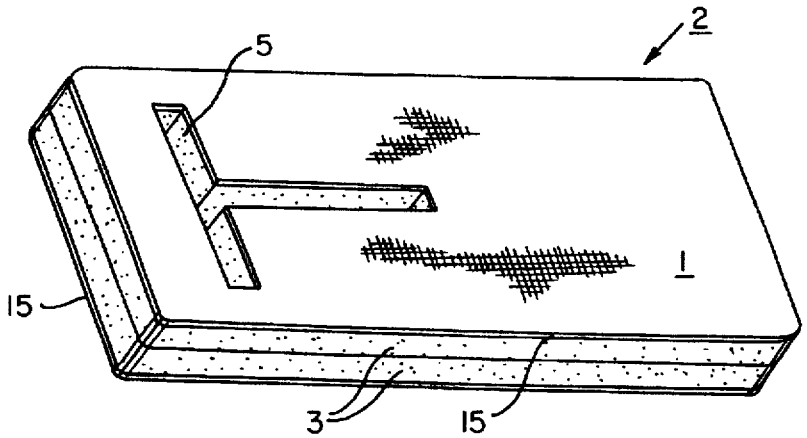
FIG. 3 is the plan view of the fabric laminated to foam in accordance with one embodiment of the invention.

FIG. 3 illustrates the autoclavable surface cleaning member 2 having an abrasion resistant exterior fabric 15 on the top surface 1. The purpose of the abrasion resistant fabric 15 is to provide a scrubbing surface that will not shred or abrade easily when in use. The ideal abrasion resistant fabric will not create any lint or fibers during use that could contaminate the cleanroom environment and be resistant to dissolving in solvents. A suitable abrasion resistant fabric must also have the ability to wick moisture from the liquid absorbing material 3. The abrasion resistant fabric is preferable a non-run knitted polyester, though any suitable abrasion resistant fabric (knitted or woven) can be used. The preferred surface fabric is a non-run polyester have a basis weight of 144 g/m$^2$ with the following additional characteristics.

| | |
|---|---|
| Sorbency - Extrinsic (ml/m$^2$) | 409 |
| Intrinsic (ml/g) | 2.84 |
| Rate | Instant |
| Abrasion Resistance (% loss) | 0.1 |
| Tear Resistance (Kg) warp | 12.0 |
| fill | 12.3 |
| Extractibles (g/m$^2$) | |
| Deionized Water | 0.026 |
| 1,1,1-trichloroethane | 0.170 |
| Ions (ppm) sodium | 6 |
| chloride | 3 |
| Total inorganic matter (ppm) | 3700 |
| Particles ≧ 0.5 μ/m$^2$ (millions) | 32 |
| (after cut and washed) | |

All tests are performed to standard ASTM procedures.

Abrasion resistant fabric 15 is bonded to absorbing interior material 3 in any number of suitable methods, such as well known laminating techniques, gluing, tacking, flame lamination or sewing. The most important criteria in determining which method to use in attaching an abrasion resistant fabric to the absorbing material is that the fabric be sufficiently secure such that it does not become loose during repeated use and autoclaving and be solvent resistant. A preferred method is to flame laminate the fabric to the absorbing interior material. This is done by passing the absorbing interior material over an open flame which slightly melts the absorbing material's surface whereupon the fabric is immediately joined thereto. This technique eliminates the need for using an adhesive.

FIG. 3 illustrates that the fabric is flame laminated to the absorbing material or foam along the entire contact surface between the absorbing material 3 and fabric 15 such that fabric 15 is connected to material 3 in as many points as possible. Liquid absorbing material 3 can be any suitable foam or sponge type material that has sufficient integrity to accommodate and enclose frame 4 and withstand repeated use and autoclaving. The preferred liquid absorbing material is an ester based polyurethane foam such as a 60 PPI polyester having a basis weight of 405 g/m$^2$ characteristics as measured by standard ASTM (D-3574-86) methods of testing flexible cellular materials—slab and molded urethane foam.

| Density (lbs/ft.$^3$) | 1.80 ± 10% Minimum | Average |
|---|---|---|
| Tensile Strength (psi) | 20 | 24.0 |
| Ultimate Elongation (%) | 100 | 145 |
| Tear Resistance (psi) | 130 | 2.0 |
| Compression Set, $C_+$% | | |
| 50% Deflection | max. 10% | |
| Compress Force Deflection (psi) | | |
| 25% Deflection | 0.60 | 0.85 |
| 70% Deflection | 1.30 | 1.75 |

-continued

| | |
|---|---|
| Clickability | Excellent |
| Cell Count (visual) pores/inch | 50–60 |
| Retention of tensile strength after six hours steam autoclave @ 105° C. | |

FIG. 3 also illustrates the absorbing material 3 as two pieces stacked one on top of the other. In FIG. 3, two similarly sized pieces of liquid absorbing material 3 are attached together using a suitable hot melt adhesive. One such suitable hot melt adhesive is synthetic resin 80-8294 manufactured by United Fusion Products, Inc. The hot melt adhesive is placed along the extreme perimeter such that the two pieces of absorbing material are joined only along the edges. By joining the two pieces of absorbing material 3 along the outer perimeter edges, a pocket is created to envelope frame 4 when it is inserted through slit 5. It also possible to use a one piece absorbing material into which a pocket is created.

The "T" shaped slit 5 is also shown on top surface 1. Slit 5 creates an entry in the abrasion resistant fabric 15 and pliable absorbing material 3 through which frame 4 can be inserted and moved longitudinally down the pocket until completely enclosed within pocket 17. Frame 4 fits snugly into pocket 17 created by the layers of pliable absorbing material 3. The dimensions of slit 5 can vary and will depend on the size of frame 4. Slit 5 should be large enough to permit frame 4 to enter, but not so large so that the frame can work its way out of pocket 17 during use. Pocket 17 is preferably the about same size as frame 4 or slightly larger.

FIG. 4 illustrates the layered construction of one embodiment of surface cleaning member 2. Both the top surface 1 and bottom side of surface cleaning member 2 have abrasion resistant fabric 15 that has been attached thereto. Pocket 17 in the center is capable of enveloping the frame member (as illustrated in FIG. 1). By enclosing frame 4, any damage during cleaning that could be caused by hitting sensitive instruments and/or piping on the walls and floors with the frame is avoided.

The abrasion resistant fabric 15 and liquid absorbing material 3 are preferably cut using well known laser cutting technology. By using a laser to cut the abrasion resistant exterior fabric 15 and liquid absorbent interior material 3, any fabric pieces or lint created by the cutting action are melted into the fabric and thereby bound thereto. The simultaneously cutting and melting prevents any potential contamination such as loose fibers or pieces of foam from forming and later being available to contaminate the cleanroom environment.

FIG. 5 illustrates one example of an autoclavable frame member 4 having free end portions that are substantially axially aligned. Frame 4 is depicted in FIG. 5 as being made from a cylindrical rod that has been formed into substantially a rectangular shape. In this invention, the shape of frame 4 and surface cleaning members 2 can be of any desired shape. The rectangular shape illustrated here is a preferred shape. Rod 7 of frame 4 provides support to the surface cleaning member 2 and has attached thereto plate 9. Plate 9 serves as a platform onto which is attach hairpin bracket 11. Hairpin bracket 11 can be attached to plate 9 using any of well know attaching means and depends on the materials used. In this drawing, bracket 11 is attached to plate 9 by means of a flange covering the brackets. Bracket 11 can also be welded to plate 9. FIG. 5*a* illustrates hairpin bracket 11 standing alone. Suitable material for rod 7, bracket 11, plate 9, or coupling member 6 include but is not limited to stainless steel or anodized aluminum.

Hairpin bracket 11 has a "keyhole" loop, as shown as 11*a* in FIG. 5*a*. The "keyhole" of hairpin bracket 11 fits into groove 16 (illustrated in perspective in FIG. 6) in coupling member 6 permitting the coupling member to rotate in one plane with respect to frame 4. A bolt is inserted through groove 16 and keyhole 11*a* in order to movably secure coupling member 6 to plate 9. Coupling member 6 is designed to accept a handle so that an operator scrubbing a cleanroom can reach to a desired length. The handle is typically welded to or crimped onto the coupling member. Coupling member 6 is movably secured so that operator can more easily move the surface cleaning member 2 around or behind instruments and equipment that may be present in the cleanroom. That is, the coupling member is sufficiently movable so as to permit an attached handle to be substantially parallel to rod 7 in one position and substantially perpendicular to rod 7 in another position. In addition to using the illustrated means to connect the coupling member 6 to frame 4, it is foreseeable to use a joint that permits rotation in more than one plane, e.g. a ball joint or a universal joint.

FIG. 6 illustrates the side perspective view of the coupling member 6 mounted to plate 9 on frame 4. Coupling member 6 has groove 16 for receiving the "keyhole" feature of hairpin bracket 11. A bolt (not visible) and nut 13 secures bracket 11 to coupling member 6.

Thus there has been disclosed an autoclavable wall washing system capable of cleaning walls, floors, ceilings and corners. The system provides superior maneuverability, high sorbency non-contaminating, and solvent resistance and is economical and easy to use and wring. The system includes a special designed replaceable mop head cleaning member for cleanroom environments that comprises an abrasion resistant exterior fabric on highly absorbent interior material. The abrasion resistant fabric and absorbent material are bonded in such a way that they will stay joined even after autoclaving or use with industrial solvents or sterilizing solutions. The abrasion resistant fabric protects the liquid absorbing interior material and prevents it from abrading and generating particles during use and creates very little of its own fibers and particles during use. The edges of the fabric have been melted and sealed so as to further reduce the generation of fibers and particles during use. The abrasion resistant fabric also has the ability to wick liquid from the absorbent foam material through to the surface being cleaned. The mop head cleaning member is designed to have an interior cavity or pocket into which a support frame can be inserted and enveloped. The support frame is designed to give sufficient rigidity to the mop-head so as to withstand any applied pressure from the operator during cleaning. Furthermore, the support frame has a movable joint and a means to connect the mop head to a handle. The moveable joint permits a handle to be moved in at least one plane.

The detailed description has been given for clearness of understanding and is not meant to be a limitation on the breadth and scope of the invention disclosed herein.

What is claimed is:

1. An autoclavable surface cleaning system, comprising:

a) an autoclavable frame member with substantially planar free end portions capable of attaching to a surface cleaning member, b) an autoclavable handle coupling member mounted on said frame member such that said frame member is capable of being coupled to a handle, and c) a replaceable autoclavable surface cleaning member coupled to said frame member including a liquid absorbent, solvent resistant, interior material, said interior material being configured in the shape of a substantially solid block having upper and lower planar surfaces, and an abrasion resistant, solvent resistant, exterior material that resists forming particle fibers and lint during use, said exterior material substantially covering the upper and lower surfaces of said liquid absorbent interior material, and bonded to said liquid absorbent interior material substantially over the interface therebetween, so as to substantially minimize fiber particles and lint from being created from said interior material during use of said surface cleaning member.

2. The autoclavable surface cleaning system as in claim 1, wherein said exterior material is bonded to said interior material using a flame lamination process.

3. A replaceable autoclavable surface cleaning member used as a mop head, said cleaning member comprising a mechanism for attachment to a handle assembly, a liquid absorbent interior material, said interior material being configured in the shape of a substantially solid block having upper and lower planar surfaces, and an abrasion resistant exterior material substantially covering the upper and lower surfaces of said liquid absorbent interior material, and bonded to said liquid absorbent interior material substantially over the interface therebetween, to substantially resist abrasion thereof and to substantially minimize the generation of particles from said interior material during use of said surface cleaning member.

4. The replaceable autoclavable surface cleaning member of claim 3, wherein the exterior material is a non-run knit polyester that substantially resists creating the particles during use and the interior material is an ester based polyurethane foam for absorbing fluid.

5. The replaceable autoclavable surface cleaning member of claim 4 wherein the exterior material is bonded to the interior material using a flame lamination process.

6. The replaceable autoclavable surface cleaning member as in claim 3, wherein said interior material comprises two layers, wherein said attachment mechanism comprises a pocket defined by and between said two layers to receive a frame member for attachment to a handle, and wherein a T-shaped slot extends through said exterior material and one of said layers to said pocket to permit the insertion of said frame member into said pocket.

7. The replaceable autoclavable surface cleaning member as in claim 3, wherein said exterior material comprises a non-run polyester having a basis weight of approximately 144 g/m$^2$ (grams per square meter).

8. The replaceable autoclavable surface cleaning member as in claim 3, wherein said exterior material has an approximate extrinsic sorbency of 409 ml/m$^2$ (milliliters per square meter).

9. The replaceable autoclavable surface cleaning member as in claim 3, wherein said exterior material has an approximate intrinsic sorbency of 2.84 ml/g (milliliters per gram).

10. The replaceable autoclavable surface cleaning member as in claim 3, wherein said exterior material has an approximate loss abrasion resistance of 0.1 percent.

11. An autoclavable surface cleaning system, comprising:

a) an elongated autoclavable frame member with free end portions capable of attaching to a surface cleaning member;

b) an autoclavable handle coupling member pivotally mounted on said frame member and configured to receive a handle; and c) a replaceable autoclavable surface cleaning member coupled to the frame member, said cleaning member comprising an interior block constructed from liquid absorbent, solvent resistant material, and an abrasion resistant, solvent resistant, exterior material configured to resist the formation of fiber particles and lint during use, said exterior material bonded to said interior block substantially over the interface therebetween in a manner configured to substantially cover said interior block and to substantially minimize the creation of fiber particles and lint from said material of said interior block during the use of the surface cleaning member.

12. The autoclavable surface cleaning system as in claim 11, wherein said exterior material is of a sufficient porosity to permit wicking from said liquid absorbent material.

13. The autoclavable surface cleaning system as in claim 11, wherein said frame member comprises a rod formed to a rectangular shape.

14. The autoclavable surface cleaning system as in claim 11, wherein said coupling member is pivotally attached to said frame member by an attachment member, said attachment member comprising a hairpin bracket.

15. The autoclavable surface cleaning system as in claim 11, wherein said exterior material comprises a non-run polyester having a basis weight of approximately 144 g/m$^2$ (grams per square meter).

16. The autoclavable surface cleaning system as in claim 15, wherein said exterior material has an appropriate extrinsic sorbency of 409 ml/m$^2$ (milliliters per square meter), an approximate intrinsic sorbency of 2.84 ml/g (milliliters per gram), and an approximate loss abrasion resistance of 0.1 percent.

17. The autoclavable surface cleaning system as in claim 11, wherein said interior block comprises two layers defining a pocket therebetween to receive said frame member.

18. The autoclavable surface cleaning system as in claim 17, wherein a T-shaped slot extends through said exterior material and one of said layers to said pocket to permit the insertion of said frame member into said pocket.

* * * * *